US009410253B2

(12) United States Patent
Shreffler, III

(10) Patent No.: US 9,410,253 B2
(45) Date of Patent: Aug. 9, 2016

(54) ANODE ASSEMBLY WITH SAND BACKFILL FOR CATHODIC PROTECTION SYSTEMS AND METHOD OF INSTALLING THE SAME FOR ABOVE GROUND STORAGE TANK APPLICATIONS

(71) Applicant: Matcor, Inc., Chalfont, PA (US)

(72) Inventor: Glenn Wright Shreffler, III, North Wales, PA (US)

(73) Assignee: Matcor, Inc., Chalfont, PA (US)

( * ) Notice: Subject to any disclaimer, the term of this patent is extended or adjusted under 35 U.S.C. 154(b) by 45 days.

(21) Appl. No.: 14/204,443

(22) Filed: Mar. 11, 2014

(65) Prior Publication Data

US 2014/0262756 A1 Sep. 18, 2014

Related U.S. Application Data

(60) Provisional application No. 61/787,135, filed on Mar. 15, 2013.

(51) Int. Cl.

| | |
|---|---|
| ***C23F 13/00*** | (2006.01) |
| ***C23F 13/12*** | (2006.01) |
| ***C23F 13/06*** | (2006.01) |
| ***C23F 13/10*** | (2006.01) |

(52) U.S. Cl.

CPC ..... *C23F 13/12* (2013.01); *C23F 13/06* (2013.01); *C23F 13/10* (2013.01); *C23F 2213/22* (2013.01); *Y10T 29/49117* (2015.01)

(58) Field of Classification Search

CPC ..... C23F 13/02; C23F 13/06; C23F 13/08; C23F 13/10; C23F 13/16; C23F 13/18; C23F 2201/02; C23F 2213/22; C23F 2213/30–2213/32; C23F 13/12

USPC ..... 204/196.01, 196.33, 196.36, 196.37

See application file for complete search history.

(56) References Cited

U.S. PATENT DOCUMENTS

| | | | | |
|---|---|---|---|---|
| 2,601,214 | A * | 6/1952 | Robinson | 204/196.15 |
| 3,488,275 | A * | 1/1970 | Loyd | 204/196.16 |
| 5,176,807 | A | 1/1993 | Kumar | |

(Continued)

FOREIGN PATENT DOCUMENTS

EP 0623691 A1 11/1994

OTHER PUBLICATIONS

Bushman (Impressed Current Cathodic Protection System Design, Bushman & Associates, Inc, 2008, pp. 1-17, http://www.bushman.cc/pdf/impressed_current_system_design.pdf).*

(Continued)

*Primary Examiner* — Luan Van
*Assistant Examiner* — Alexander W Keeling
(74) *Attorney, Agent, or Firm* — Caesar Rivise, PC

(57) ABSTRACT

An anode assembly and method for installing it in a cathodic protection system for an aboveground storage tank is disclosed. The anode assembly basically comprises an elongated electrically conductive anode, a fabric housing and sand backfill. The fabric housing is a hollow member in which the sand is located and through which the anode extends. The anode includes portions extending out of the housing for connection to the cathodic protection system. The anode assembly is arranged to be installed on a flat prepared surface below the bottom of the storage tank, whereupon the anode assembly's weight hold it flat on that surface without the need for staking or other means to hold the assembly flat. The ground with the anode assembly can then be backfilled to the level of the bottom of the storage tank.

4 Claims, 1 Drawing Sheet

(56) References Cited

U.S. PATENT DOCUMENTS

| | | | | |
|---|---|---|---|---|
| 5,340,455 | A | 8/1994 | Kroon et al. | |
| 5,411,646 | A * | 5/1995 | Gossett | C23F 13/16 204/196.33 |
| 5,505,826 | A * | 4/1996 | Haglin et al. | 205/731 |
| 5,948,218 | A * | 9/1999 | Kheder et al. | 204/196.33 |
| 2008/0230398 | A1 * | 9/2008 | Glass | C23F 13/02 205/734 |
| 2010/0044218 | A1 * | 2/2010 | Funahashi | 204/280 |

OTHER PUBLICATIONS

Arnoux Chauvin et al., "AEMC_SoilResistivity", Aug. 7, 2002, pp. 1-3, XP055131738, Retrieved from the Internet: URL:http://www.pema.ie/PDFs/App-Ground-SoilResistivity.pdf.

"Earthing Techniques. Soil Resistivity Testing", May 23, 2006, pp. 1-40, XP055131739, Retrieved from the Internet: URL:http://www.lightningman.com.au/Earthing.pdf.

International Search Report for PCT/US2014/024168 mailed on Aug. 6, 2014.

* cited by examiner

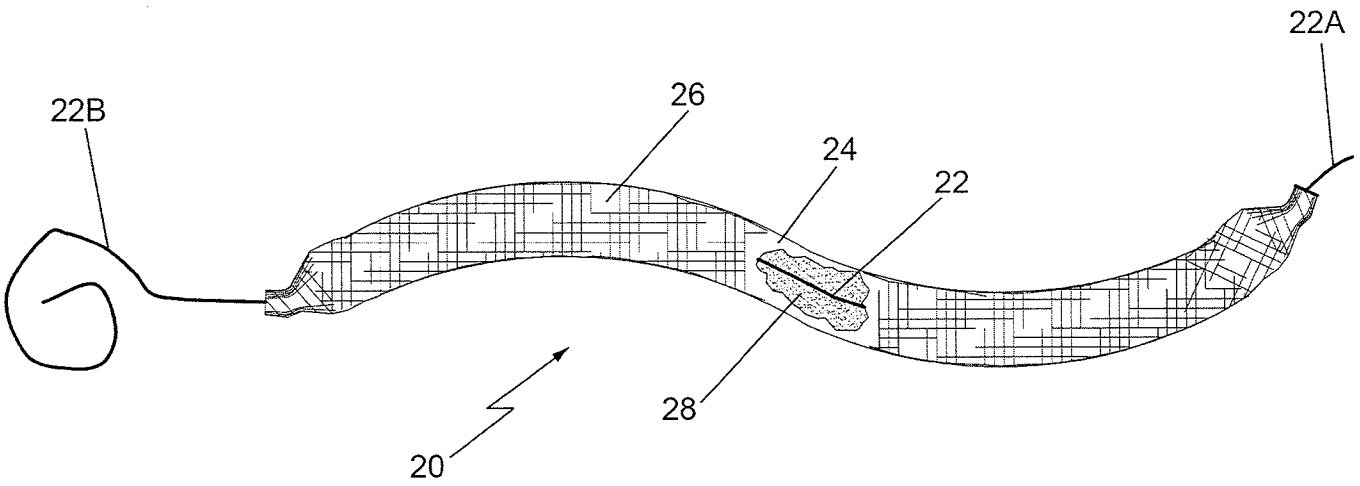
22A
22
24
26
28
20
22B

ANODE ASSEMBLY WITH SAND BACKFILL FOR CATHODIC PROTECTION SYSTEMS AND METHOD OF INSTALLING THE SAME FOR ABOVE GROUND STORAGE TANK APPLICATIONS

CROSS-REFERENCE TO RELATED APPLICATIONS

This utility application claims the benefit under 35 U.S.C. §119(e) of Provisional Application Ser. No. 61/787,135 filed on Mar. 15, 2013 entitled Anode Assembly With Sand Backfill For Cathodic Protection Systems And Method Of Installing The Same For Aboveground Storage Tank Applications, which is assigned to the same assignee as this application and whose entire disclosure is incorporated by reference herein.

FIELD OF THE INVENTION

This invention relates generally to cathodic protection systems and more particularly to anode assemblies for use for aboveground storage tank applications and methods of installing the same.

BACKGROUND OF THE INVENTION

Cathodic protection systems commonly make use of packaged linear anodes having a variety of shapes (e.g., round, flat, or other shapes) and may be either a polymeric cable anode or a Mixed Metal Oxide (MMO) wire anode housed inside a braided or unbraided fabric housing filled with conductive backfill, such as coke-breeze. These commercially available fabric-based linear anodes are similar in design and function. One particularly useful packaged linear anode for cathodic protection systems is commercially available from Matcor, Inc., the assignee of the subject invention, under the trademark SPL-FBR. That anode assembly basically comprises a fabric housing through which an electrical conductor (i.e., the anode) passes. The fabric housing is filled with coke-breeze, so that the coke breeze surrounds the anode, with the anode being centered therein. An external non-conductive braiding, such as PVC coated high strength yarn, is disposed about the fabric housing for the entire length thereof.

In order to provide cathodic protection to an aboveground steel storage tank it is a common practice to dispose a long anode assembly in a spiral or concentric pattern so that it lays flat on a prepared flat surface below where the steel tank bottom will be located. Then a layer of sand is backfilled over the anode assembly. For applications where there may be less than six inches between the anode and the steel bottom of the tank, the use of an anode assembly having a fabric housing filled with a conductive back-fill, such as the coke-breeze, can prove problematic. In this regard, the close proximity of the steel tank bottom with the coke breeze embedded anode may result in current leakage creating a hot spot or even shorting out the anode. Thus, for such shallow backfill AST applications Matcor, Inc. makes it a practice to use of a bare wire anode in a hollow non-conductive mesh housing without any conductive backfill. The conductive wire making up the anode of such an assembly is typically unwound from a reel, so that when the anode assembly is disposed on the flat prepared surface, it tends to attempt to reassume the anode's previously coiled state. This action necessitates staking the anode assembly down or otherwise providing some means to hold it as flat as possible on the prepared surface so that all portions of the anode assembly will be located approximately the same distance from the tank's bottom, thereby providing uniform cathodic protection to the tank's bottom. Needless to say it is difficult, and time consuming to lay out the anode assembly on the prepared ground surface and ensure that it is maintained flat to that surface to ensure maximum and uniform separation of it from the tank bottom.

Accordingly, a need exists for an anode assembly which can be used in shallow backfill applications for effectively protecting aboveground storage tanks and which can be readily placed in a desired flat position on a prepared surface. The subject invention addresses that need.

SUMMARY OF THE INVENTION

In accordance with one aspect of this invention an anode assembly is provided for a cathodic protection system. The anode assembly basically comprises an elongated electrically conductive anode, a fabric housing and a high-resistivity backfill. The fabric housing is a hollow member through which the anode extends. The backfill comprises sand disposed within the housing and surrounding the anode to maintain the anode in a generally centered position within the housing. The housing has a leading end and a trailing end. The anode includes a portion extending out of the leading end of the housing and a portion extending out of the trialing end of the housing.

In accordance with another aspect of this invention there is provided a method of installing an anode assembly constructed in accordance with this invention to protect an aboveground storage tank. That method basically comprises preparing the ground below the location of the bottom of the storage tank so that it is a generally flat surface. At least one anode assembly constructed in accordance with this invention can then be laid onto the prepared surface, whereupon the anode assembly assumes a generally flat configuration. Once that has been accomplished the surface with the anode assembly thereon can be backfilled with whatever backfill material is desired to the level of the location of the bottom of the storage tank and the anode assembly coupled to a cathodic protection system.

DESCRIPTION OF THE DRAWING

The invention will be described in conjunction with the following drawings in which like reference numerals designate like elements and wherein:

FIG. 1 is a plan view, partially in section, of one exemplary embodiment of an anode assembly constructed in accordance with this invention.

DETAILED DESCRIPTION OF THE PREFERRED EMBODIMENT

Referring now to the various figures of the drawing wherein like reference characters refer to like parts, there is shown at 20 in FIG. 1 one exemplary embodiment of an anode assembly 20 constructed in accordance with the subject invention. The anode assembly 20 is similar in construction to the SPL-FBR anode assembly of Matcor, Inc., except that it incorporates a high-resistivity backfill in lieu of the conductive coke-breeze. As can be seen the anode assembly 20 basically comprises an elongated flexible electrical conductor, e.g., MMO/platinum, which forms the anode 22 of the anode assembly. The anode is disposed within a hollow fabric housing 24 so that one end portion 22A comprising #8 HMWPE insulated cable extends out of the leading end of the assembly, and one end portion 22B also comprising #8 HMWPE insulated cable extends out of the trailing end of the assembly. The fabric housing is approximately 1.5 inches in diameter and the anode 22 is centered within the housing. An external non-conductive braiding 26, such as PVC coated high strength yarn, is disposed about the fabric housing for the entire length thereof.

In accordance with this invention a high resistivity material, e.g., clean dry sand 28 is disposed within the housing so that it completely surrounds the centered anode 22. The sand has a nominal resistivity between 20,000 and 200,000 ohm-cm.

The anode assembly 20 can be of any length, from 10 feet to lengths of more than 1,000 feet and is flexible so that it can be configured into any desired shape, e.g., a coiled or concentric pattern for disposition over the entire area making up the bottom of the tank. The extending portions 22A and 22B of the anode 22 are arranged to be connected to the cathodic protection system rectifier (not shown).

As should be appreciated by those skilled in the art since the anode assembly of this invention makes use of a fabric housing that is backfilled with sand in lieu of coke-breeze it can be used for shallow, e.g., less than six inch, backfill applications for aboveground storage tanks, without risk of shorting out the anode or otherwise producing a hot spot. Moreover, the use of the non-conductive sand as the backfill in the fabric housing provides the assembly of this invention with a much higher weight per foot than prior art anode assemblies merely consisting of an anode within a mesh housing. This feature acts to hold the anode assembly in a flat orientation on the prepared surface, notwithstanding the propensity of the anode wire to attempt to return to its prior coiled configuration. Accordingly, anode assemblies constructed in accordance with this invention can be easily installed and will remain flat during construction, thereby maintaining the critical, maximum distance from the tank bottom.

The following is one exemplary manner of installing an anode assembly constructed in accordance with this invention to protect an aboveground storage tank having a generally flat bottom. That method basically comprises preparing the ground below the location of the bottom of the storage tank so that it is a generally flat surface. Once that has been accomplished at least one anode assembly constructed in accordance with this invention is laid onto the prepared surface in whatever pattern is desired, e.g., a helical pattern, a concentric pattern, or some other pattern encompassing the bottom of the tank, whereupon the anode assembly assumes a generally flat configuration on the prepared surface without necessitating other means to hold it in place. Once that has been accomplished the surface with the anode assembly thereon can be backfilled with whatever backfill material is desired, e.g., sand, to the level of the location of the bottom of the storage tank. The anode assembly can then be electrically coupled to a cathodic protection system rectifier.

It should be pointed out at this juncture that the anode assembly disclosed above is not limited to the exemplary features described above. Thus, for example, the anode itself it can be formed of any suitable electrical conductor. The fabric housing can be formed of any suitable non-conductive material. The braiding, if used at all, can be formed of any suitable non-metallic material. All of those components can be of any desired shape and/or size depending upon the cathodic protection system in which the anode assembly will be used. With respect to the method of installing the anode assembly of this invention, the exemplary method disclosed above is merely exemplary of various installation methods that can be accomplished using the anode assembly of this invention.

Without further elaboration the foregoing will so fully illustrate my invention that others may, by applying current or future knowledge, adopt the same for use under various conditions of service.

I claim:

1. An anode assembly for a cathodic protection system to protect an above-ground storage tank, wherein said anode assembly is configured for location in a flat plane in the ground below the bottom of the storage tank and wherein said anode assembly comprises an elongated electrically conductive wire anode, a fabric housing and a high-resistivity dry sand backfill having a nominal resistivity of 20,000 to 200,000 ohm-cm, said anode being formed of at least one of MMO or platinum, said fabric housing being a hollow member through which said anode extends, said backfill being disposed within said hollow housing and surrounding said anode to maintain said anode in a generally centered position within said housing, said housing having a leading end and a trailing end, said anode including a portion extending out of said leading end of said housing and a portion extending out of said trailing end of said housing.

2. The anode assembly of claim 1 additionally comprising a non-metallic braiding extending about said housing.

3. The anode assembly of claim 1 wherein said anode comprises MMO.

4. The anode assembly of claim 1 wherein said anode comprises platinum.

* * * * *